United States Patent [19]

Sellars et al.

[11] 4,186,222

[45] Jan. 29, 1980

[54] MOULD INSULATION

[75] Inventors: Hubert D. Sellars; David Mills; Michael F. J. Ford, all of Bristol, England

[73] Assignee: Rolls-Royce (1971) Limited, London, England

[21] Appl. No.: 896,211

[22] Filed: Apr. 13, 1978

Related U.S. Application Data

[63] Continuation of Ser. No. 720,589, Sep. 7, 1976, abandoned.

[30] Foreign Application Priority Data

Sep. 20, 1975 [GB] United Kingdom ..... 38711/75

[51] Int. Cl.[2] ..... B22C 9/08

[52] U.S. Cl. ..... 427/134; 106/38.27; 106/38.9; 164/26; 164/41; 427/133

[58] Field of Search ..... 164/23–26, 164/41, 27; 427/133, 134; 106/38.27, 38.9

[56] References Cited

U.S. PATENT DOCUMENTS

| | | | |
|---|---|---|---|
| 3,126,597 | 3/1964 | Operhall | 164/27 |
| 3,654,984 | 4/1972 | Mellen | 164/26 |
| 4,063,954 | 12/1977 | Brown | 164/23 |

FOREIGN PATENT DOCUMENTS

| | | | |
|---|---|---|---|
| 47-14630 | of 1972 | Japan | 164/23 |
| 797514 | of 1955 | United Kingdom . | |
| 952270 | of 1964 | United Kingdom . | |
| 1093895 | of 1967 | United Kingdom . | |
| 1172773 | of 1969 | United Kingdom . | |

*Primary Examiner*—Sam Silverberg

*Attorney, Agent, or Firm*—Stevens, Davis, Miller & Mosher

[57] ABSTRACT

A method of insulating a shell mould for investment casting by adhering a particulate or fibrous insulator such as perlite, vermiculite or ceramic fibres to a shell mould by an adherent coating. In a preferred process the shell mould is first dipped into the adherent coating and the particulate insulator is applied to the mould through a stuccoing process. Multiple layers of insulation can be applied to the mould to vary the thickness of insulation as required.

6 Claims, 3 Drawing Figures

| INGREDIENT | PROPORTION BY VOLUME OR MASS |
|---|---|
| SYTON x 30 | 2400 mls |
| WATER | 1400 mls |
| OCTYL ALCOHOL | 30 mls |
| TEEPOL 610 | 15 mls |
| TEEPOL ANTIFOAM | 5 mls |
| 2% METHYL CELLULOSE SOLN | 200 mls |
| PERLITE 325 MESH U.S. STD | UP TO A MAXIMUM OF 700 GRAMS |

TABLE I

FIG. 2

| INGREDIENT | PROPORTION BY VOLUME OR MASS |
|---|---|
| SYTON x 30 | 2400 mls |
| WATER | 1400 mls |
| OCTYL ALCOHOL | 30 mls |
| TEEPOL 610 | 15 mls |
| TEEPOL ANTIFOAM | 5 mls |
| 2% METHYL CELLULOSE SOLN | 200 mls |
| VERMICULITE 20 MESH U.S. STD | UP TO A MAXIMUM OF 800 GRAMS |

TABLE II

FIG. 3

MOULD INSULATION

This is a continuation of application Ser. No. 720,589 filed Sept. 7, 1976, now abandoned.

This invention relates to mould insulation and more particularly to a mould insulation suitable for use on an investment casting shell mould.

It is at present known to control the mode of solidification of metal during investment casting. In vacuum casting it is normal practice to place the investment shell moulds in a nickel base alloy box and to fill the space between the nox and the mould with a material that has two functions. Firstly, the material provides mechanical support for the mould to prevent relative movement of the mould parts during the casting procedure, and secondly the material acts as an insulator which assists in controlling the rate of heat loss from the cast mould. In some situations, generally with relatively small shell moulds, it is permissible to dispense with the backing material and to wrap portions of the shell moulds with asbestos cloth or a kaolin fibre blanket or a combination of both. In particular the disposition of the asbestos or kaolin fibre blanket on the shell mould is to a certain extent controllable to influence the preferential direction of solidification of the article after casting.

Both the above systems of mould insulation have disadvantages, in particular the boxes are relatively costly items and, together with the vacuum material, have a large thermal mass which requires pre-heating and increases mechanical handling problems and makes it difficult to selectively insulate parts of a shell mould. The wrapped shell moulds are fairly labour intensive to manufacture and require the cutting of templates and a degree of manual dexterity in wiring the insulation to the shell mould. The success of the procedure depends upon the skill of the operator and small variations can prove critical to the quality of the as-finished casting. Furthermore, asbestos is associated with a serious health hazard which makes it desirable to eliminate its use if at all possible. There exists a range of types of shell mould which it is particularly difficult to apply the "wrapping technique" to as the spaces in between adjacent parts of the shell mould, and the general disposition of the parts of the shell mould, make the attachment of the wrapping particularly tricky.

The present invention seeks to provide an alternative type of shell mould insulation which at least partially overcomes the disadvantages associated with the known methods and which enables a more careful control of the heat dissipation from and hence the solidification of the as-cast mould.

According to the present invention there is provided a method of insulating shell moulds comprising the steps of forming a shell mould and coating at least a portion of the shell mould with an adherent material and an insulator in particulate or fibrous form.

In a modification a coating of the adherent material is applied to the shell mould and subsequently the particulate insulator is adhered to the coating.

Preferably the insulated shell mould is subsequently treated with further alternate layers of adherent coating and particulate insulator to provide a suitable thickness of insulating material.

The final coat of particulate insulator is usefully sealed by a further application of the adherent coating.

Differing thicknesses of insulation may be applied to various parts of a given shell mould by controlling the areas of application of the adherent coating or coatings.

The adherent coatings and particulate insulator are conveniently applied using the dipping and stuccoing apparatus similar to that used for producing the shell moulds.

The invention also comprises a shell mould insulated as previously detailed.

Embodiments of the invention will now be described by way of example only and with reference to the accompanying drawings in which:

FIG. 2 is a table showing the composition of a suitable adherent coating, and

FIG. 3 is a similar table showing the composition of an alternative adherent coating.

Figure 1:
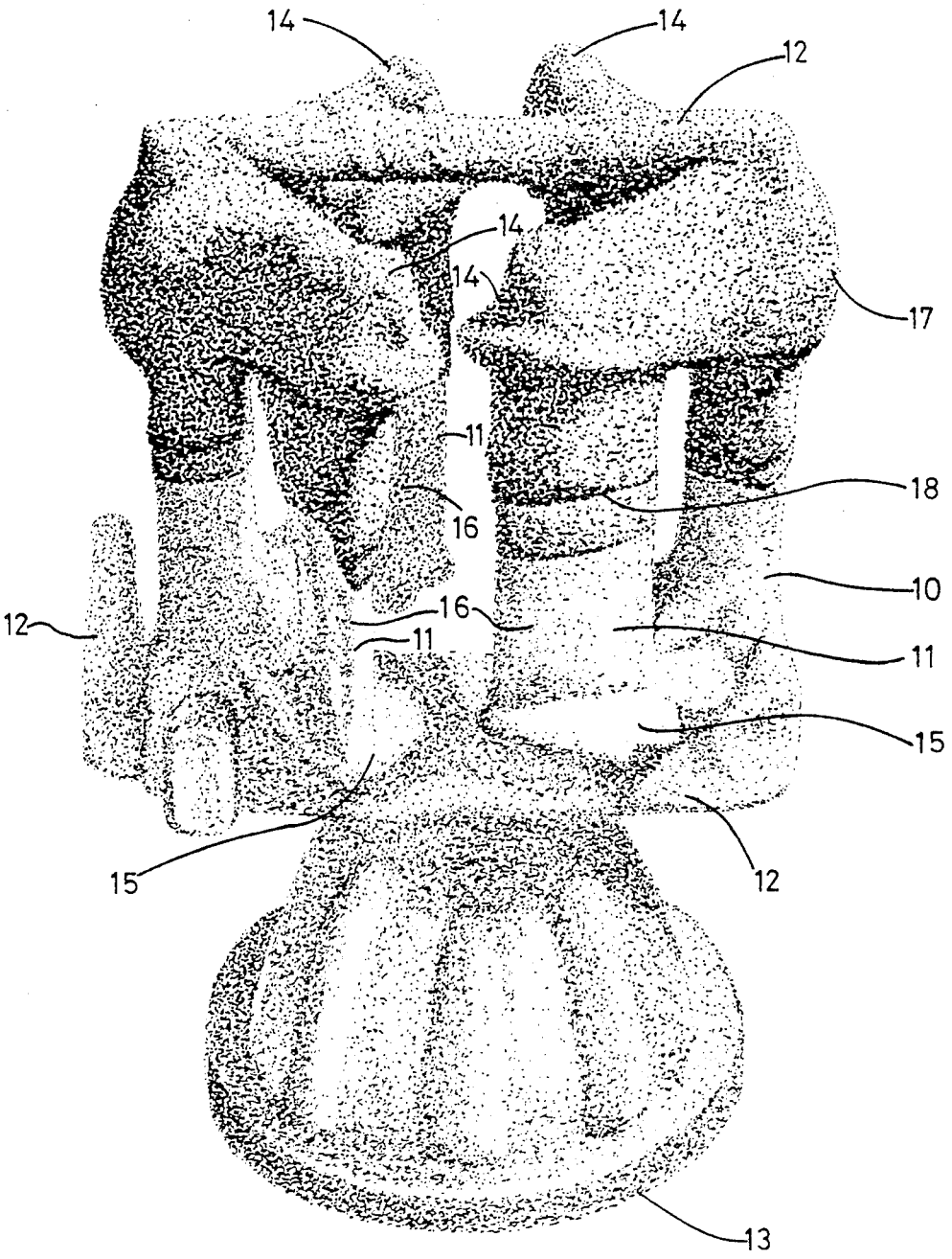
FIG. 1 is a perspective view of an insulated shell mould.

Referring now to FIG. 1 there is shown in the inverted position an investment shell mould 10 in which a plurality of moulds 11 are joined to a common riser system and running system 12, fed from a single pouring gate 13. The moulds 11 are each shaped to produce as a finished article turbine rotor blades for a gas turbine engine and the general shape of the mould can be seen to represent a root portion 14 and a radially outer shroud portion 15 at the far end of an aero-foil portion 16. Around the root and lower portion of the aero-foil there is built up an insulating coating 17 whose thickness increases towards the root portion of each mould in practice to ensure that the as-cast material solidifies in the mould according to the desired regimen.

The insulation comprises an adherent coating which is first applied to the mould by dipping the mould in a vessel containing the coating, and a particulate insulator which is applied on top of the adherent coating by sprinkling it over the mould using a conventional raining or stuccoing machine. After the first layer of adherent coating and particulate insulator is applied the shell mould is once more dipped into the adherent coating and further particulate insulator is rained over the adherent coating. Further layers of adherent coating and particulate insulator are then applied up to a total of six in this particular embodiment and the thickness of the insulation at the root portion 14 of the blade is made thicker than that at the aero-foil portion 16 of the blade moulds 11 by making subsequent dips of the mould into the adherent coating at successively decreasing depths. The boundary between two succesive layers can be clearly seen at 18. The particulate insulant only adheres to the shell mould on the parts having a layer of adherent coating.

As a final treatment to seal the insulating coating a final overall dip in the adherent coating is used. This prevents subsequent deterioration of the insulating coating by abrasion during handling.

We have experimented with a number of different possible particulate insulators and have found the following to be particularly useful:

(a) Vermiculite

This is a laminar material (aluminium, iron and magnesium silicates) resembling mica in appearance. Upon being heated above 230° C. the layers of material exfoliate to many times their original volume due to the flash formation of steam which forces the laminations apart. The expanded laminations then contain minute air layers. It is possible to exfoliate the vermiculite either before or after it has been applied to the shell mould.

However, we have found that the best results were achieved by applying it in the exfoliated form, the grain size of the vermiculite particles ranges downwards from a maximum dimension of 4 mms.

(b) Perlite

This is a siliceous volcanic rock (natural glass) containing combined water. When heated above 870° C. the flash formation of steam causes expansion from ten to twenty times its original size. The resulting structure is cellular. As with vermiculite the perlite can be applied either in the expanded or the unexpanded state and once more we found that the best results were obtained with expanded perlite. Expanded perlite does tend to be rather brittle and fryable, which is slightly disadvantageous. The grain size of the perlite particles ranges downwards from a maximum dimension of 2 mms.

(c) Kieselguhr (Diatomite) (Sintered)

The particles of this material are the silica skeletons of minute single-celled water plants. These hollow structures contain microscopic air voids and prove very satisfactory as a particulate insulator.

Two types of adherent coating were utilised with the above particulate insulators. Table 2 shows one adherent coating that was found to be most suitable with the perlite insulator. The coating comprises a 30% solution of colloidal silica in water known generally as silica sol and commercially available as Syton X30 (registered trade mark), water, octyl alcohol; a detergent surface tension reducing agent (Teepol 610—registered trade mark) and an anti-foaming agent (Teepol anti-foam—registered trade mark) together with a binder of 2% methyl cellulose solution and perlite. The perlite is in very fine powder form such that 98% of it will pass through a 325 mesh (U.S. Standard) sieve, i.e. a square aperture of 0.044 mm side. The proportions of the various constituents are as shown in the table and are blended by adding the Syton X30 and water to a mixing vessel separately mixing the octyl alcohol and the Teepol 610 and the Teepol anti-foam to form an emulsion and then blending this into the Syton X30. To this mixture the methyl cellulose and the perlite is added and the entire mix is stirred well. It is necessary to continually agitate the adherent coating to prevent it settling out. With the exception of the perlite the above mixture is useful as a dip coating for forming the shell moulds when used in connection with zircosil powder. This therefore has the advantage that this sort of material is readily available in a foundry.

In an alternative dip coating shown in Table 3, the perlite is substituted by vermiculite which is used in a finer grade than that used for the particulate insulator, namely 98% of the vermiculite will pass through a 20 mesh (U.S. Standard) sieve, i.e. a square aperture of 0.841 mm side. Owing to the slight alkalinity of the vermiculite the mix has a slight tendency to gell after approximately 12 hours thus rendering it unusable and therefore batch quantities should be sized accordingly. This second coating is rather slower at drying than the first and it is found that it can be used with a rather larger particle size of the particulate insulator. In a third alternative adherent coating the mix as shown in Table 1 is used but with unsintered diatomite substituted for the perlite.

Alternative particulate insulators have been investigated, namely molochite grain, bubble alumina and expanded shale aggregate. These insulators were found to be of inferior insulating properties to the previously listed particulate insulators and the expanded shale was found to be too heavy for satisfactory attachment to the relatively fragile shell mould.

In an alternative embodiment it is proposed to adhere ceramic fibres to the shell mould utilising a chemical binder such as silica sol. In this embodiment it should prove possible to apply the fibre and the binder in a single dipping operation so that the adherent coating includes the particulate insulator.

Trials have been carried out to test the effectiveness of applying insulation both before and after de-waxing of the shell mould. We have found that it is preferable to apply the insulation after de-waxing as the insulation has occasionally suffered some delamination during the de-waxing process.

The above-described methods of applying insulating coatings can be readily applied to shell moulds having narrow spaces or cavities between adjacent parts, thereof which are difficult to insulate by conventional methods. It is believed that the range of shell moulds that can be used without a box and backing material will be extended by taking advantage of the possibility of building up relatively thick coatings of insulation by the methods specifically described above.

What we claim is:

1. A method of thermally insulating selected regions of a finished shell mould comprising the steps of selectively building-up one or more layers of thermal insulation using at least one insulator selected from the group consisting of vermiculite, perlite and diatomite on different regions of the exterior surface of the mould, each layer being formed by first dipping the selected region of the shell mould into a container of an adherent liquid coating containing a relatively finely divided particulate thermal insulator and subsequently bringing the coated region into contact with moving particles of a relatively coarsely divided particulate thermal insulator, whereby said particles adhere to the coating on said shell mould to form a layer of insulation thereon.

2. A method according to claim 1 and including the step of varying the thickness of the insulation by selectively varying the area of application of each of said layers.

3. A method according to claim 1 and in which the adherent coating comprises a mixture of a colloidal silica, water, octyl alcohol, a detergent surface tension reducing agent, an antifoaming agent, a methyl cellulose solution and unsintered diatomite.

4. A method according to claim 1 in in which the adherent coating includes finely powdered perlite as the relatively finely divided particulate thermal insulator and further comprises a mixture of colloidal silica, water, octyl alcohol, a detergent surface tension reducing agent, an antifoaming agent, and a methyl cellulose solution, and in which the relatively coarsely divided particulate thermal insulator comprises perlite.

5. A method according to claim 1 in which the adherent coating includes finely powdered vermiculite as the relatively finely divided particulate thermal insulator and further comprises a mixture of colloidal silica, water, octyl alcohol, a detergent surface tension reducing agent, an antifoaming agent, and a methyl cellulose solution, and in which the relatively coarsely divided particulate thermal insulator comprises vermiculite.

6. A shell mould insulated by a method according to claim 1.

* * * * *